US011027313B2

(12) United States Patent
Gialis et al.

(10) Patent No.: US 11,027,313 B2
(45) Date of Patent: Jun. 8, 2021

(54) FRUIT SORTING TABLE WITH ADAPTIVE SCREEN

(71) Applicant: PELLENC, Pertuis (FR)

(72) Inventors: Jean-Marc Gialis, Cheval Blanc (FR); Remi Niero, Meze (FR)

( * ) Notice: Subject to any disclaimer, the term of this patent is extended or adjusted under 35 U.S.C. 154(b) by 128 days.

(21) Appl. No.: 16/331,254

(22) PCT Filed: Sep. 25, 2017

(86) PCT No.: PCT/FR2017/052572
§ 371 (c)(1),
(2) Date: Mar. 7, 2019

(87) PCT Pub. No.: WO2018/078230
PCT Pub. Date: May 3, 2018

(65) Prior Publication Data

US 2019/0232337 A1 Aug. 1, 2019

(30) Foreign Application Priority Data

Oct. 24, 2016 (FR) ..... 16/60278

(51) Int. Cl.
*B07B 1/14* (2006.01)
*B07B 1/42* (2006.01)
(Continued)

(52) U.S. Cl.
CPC ..... *B07B 1/14* (2013.01); *B07B 1/42* (2013.01); *B07B 1/4636* (2013.01); *B07B 13/16* (2013.01); *B07B 13/18* (2013.01)

(58) Field of Classification Search
CPC ..... B07B 1/14; B07B 1/42; B07B 1/4636; B07B 13/16; B07B 13/18
(Continued)

(56) References Cited

U.S. PATENT DOCUMENTS 3,721,345 A * 3/1973 Brown ..... B07B 1/15 209/669
4,148,398 A * 4/1979 Mustikka ..... B07B 1/4636 209/668
(Continued)

FOREIGN PATENT DOCUMENTS

| | | |
|---|---|---|
| DE | 3027651 A1 | 3/1982 |
| EP | 2457671 A2 | 5/2012 |
| FR | 2920278 A1 | 3/2009 |

*Primary Examiner* — Joseph C Rodriguez
(74) *Attorney, Agent, or Firm* — Egbert Law Offices, PLLC

(57) ABSTRACT

A fruit sorting table includes: a conveyor for conveying a fruit crop along a conveying plane, between an intake area and a discharge area, a screen extending in the conveying plane between the intake area and the discharge area, the screen having openings for sorted fruit to pass through from the conveying plane to an area for receiving sorted fruit situated under the conveying plane. The sorting table has at least one device for measuring one of a quantity of fruit and a flow rate of fruit passing through the screen over at least one reference section of the screen, the reference section being situated between the fruit intake area and the discharge area, and set apart from the fruit intake area, a device for adjusting the sorting table in response to the measurement device. Application, in particular, to sorting a grape crop.

18 Claims, 5 Drawing Sheets

(51) Int. Cl.
*B07B 1/46* (2006.01)
*B07B 13/16* (2006.01)
*B07B 13/18* (2006.01)

(58) Field of Classification Search
USPC ..... 209/667, 668
See application file for complete search history.

(56) References Cited

U.S. PATENT DOCUMENTS 5,236,093 A 8/1993 Marrs
5,298,119 A 3/1994 Brown
5,386,766 A * 2/1995 Segredo ..... A23N 1/003 100/45
5,740,922 A * 4/1998 Williams ..... A01D 17/06 209/668
6,343,234 B1 * 1/2002 Thomas ..... B07B 11/04 700/28
7,938,272 B2 * 5/2011 Antila ..... B07B 1/005 209/247
7,994,448 B2 * 8/2011 Kenny ..... B07B 1/15 209/576
8,430,249 B2 * 4/2013 Visscher ..... B07B 1/15 209/643
8,642,910 B2 * 2/2014 Pellenc ..... A01D 46/285 209/576
8,763,815 B2 * 7/2014 Pellenc ..... B07B 1/15 209/668
8,770,501 B2 * 7/2014 Laukka ..... B02C 25/00 241/29
9,146,554 B2 * 9/2015 Hoban ..... G06Q 10/06
2014/0144118 A1 * 5/2014 Le Neve ..... B65G 13/04 56/328.1
2015/0027935 A1 * 1/2015 Palmbos ..... B07B 1/14 209/668

* cited by examiner

FRUIT SORTING TABLE WITH ADAPTIVE SCREEN

TECHNICAL FIELD

The present invention concerns a fruit sorting table with adaptive screen.

It concerns more precisely a sorting table usable for the elimination of foreign matter remaining mixed in with a fruit crop or harvest of grape berries.

Such a sorting table serves in particular to separate on the one hand grape berries and on the other hand leaves, leaf stalks or bulkier or items of debris longer than the grape berries (leaves, vine tendrils, stalks, leaf stems, . . . ). This is debris that is likely to be found among grape berries and in particular grape berries having undergone a stalk stripping operation.

In more general terms, the invention can be applied for the elimination of debris in a fruit crop, and in particular of small fruit such as gooseberries, black-currant, blackberries, raspberries, olives, cranberries, huckleberries or still other berries or drupes.

STATE OR PRIOR ART

The state of the art can be illustrated by the following documents:

FR 2920278
EP 2457671
DE 3027651
U.S. Pat. No. 5,236,093
U.S. Pat. No. 5,298,119

The known sorting tables, for example that of document FR 2920278, include a plurality of parallel conveyor-sorters, arranged according to a sorting scheme.

The conveyor-sorters rollers are regularly spaced to each other and form a screen.

A crop or a harvest of grape berries dropped on the intake of the sorting table is conveyed in the direction of a discharge end of the sorting table through the rotation of the conveyor-sorter rollers.

During the transport, the fruit or berries are able to pass through the spaces provided between the conveyor-sorter rollers to be collected under the sorting table. whereas the debris, in particular leaf stalks, leaves, leaf stems or small twigs contained in the crop or among the grape berries continue their travel to the discharge end of the sorting table. This debris, on account of its size, its elongated or flat shape, or its weight, is in effect more likely to continue traveling parallel to the sorting table rather than dropping through the sorting table.

When a sorting table is properly adjusted, only debris reaches the end of the sorting table and is discarded, all the fruit or grape berries having previously dropped through the sorting table during the conveying operation.

The main parameters for adjustment of a sorting table are the intake rate of fruit on the table, the conveying speed, determined by the speed of rotation of the conveyor-sorters, and the spacing between the determining the opening of the screen. Too narrow spacing between the rollers, excessive speed of rotation or too high a dumping rate result in fruit arriving at the discharge end of the table and being disposed of, together with the debris. Inversely, too wide spacing between the rollers or too slow rotation speed lead to the undesirable passage of debris through the sorting table, together with the fruit.

The speed of rotation of the conveyor-sorter rollers can be adjusted by controlling the driving means for the rotation of the conveyor-sorter rollers.

The screen opening, formed by the spaces between the conveyor-sorter rollers, can be modified by adjusting a spreading of the axes of the conveyor-sorter rollers. The opening of the screen, that is to say its capacity to let the fruit pass through, depends in effect on the spacing between the conveyor-sorter rollers. Thus, the document EP 2457671 proposes to mount the ends of the conveyor-sorter rollers on slides perpendicular to their axis.

The document DE 3027651 describes a sorting device with a possibility of adjusting the opening and the inclination of a roller conveyor.

Documents U.S. Pat. Nos. 5,236,093 and 5,298,119 describe sorting and sizing devices for wood shavings.

DISCLOSURE OF THE INVENTION

The invention is the result of identifying a certain number of technical problems associated with the adjustment of the sorting table. A first problem is that optimal adjustment of the sorting table generally does not take into account the variation of the quality or quantity of the grape berries to be sorted. Quality variation refers to variation of the size of the fruit or berries, also to a variation of the amount and type of debris mixed in with the fruit. For example, during the sorting of a crop of grape berries, a quality variation may refer to the grape variety of the grape harvest. It may also refer to the parcel of land, or even to a portion of a parcel, of provenance of the grapes of the harvest to be sorted. Finally, variation of quality is also observed between a clean grape harvest and one that contains crushed or spoiled grapes.

Variation of quantity refers to a variation of the rate of fruit or grape berries at the intake of the sorting table. It may be connected to quantity variations of clusters of grapes picked mechanically by a grape harvester. It may also be connected to variations of the flow of fruit coming from a supply device of a sorting table used as storage.

Another difficulty relates to the constant evaluation of the proper adjustment of the sorting table and the early detection of an inadequate setting. In effect, the late discovery of excessive concentration of debris in the sorted fruit or to the contrary, the presence of fruit among the discarded debris leads to a qualitative and/or quantitative loss of the sorted fruit.

The present invention has therefore the aim to propose a fruit sorting table which does not present the aforementioned difficulties.

One aim in particular is to propose an adaptive sorting table with an evaluation capacity of the adequacy of settings with the crop to be sorted, and a capacity of adjustment of the sorting parameters, during a sorting operation, without interrupting the operation of the sorting table.

In order to achieve these goals, the invention proposes more precisely a fruit sorting table which includes:

- a conveyor for conveying a fruit crop along a conveying plane, between an intake area and a discharge area,
- a screen, extending in the conveying plane between the intake area and the discharge area, the screen having openings for fruit to pass through from the conveying plane to an area for receiving sorted fruit situated under the conveying plane and, an adjustment device for the selectivity of the sorting table.

In accordance with the invention, the sorting table also includes:

at least one device for measuring one of a quantity of fruit and a flow rate of fruit passing through the screen over at least one reference section of the screen, the reference section being situated between the fruit intake area and the discharge area and set apart from the fruit intake area.

The adjustment device for the selectivity of the sorting table serves to modify one or several operating parameters of the sorting table influencing its selectivity. In particular, the adjustment device may be a device acting on at least one parameter among:

a conveying speed of the conveyor a screen caliper an intake rate of the conveyor, an incline of the conveyor relative to the horizontal.

As indicated in the introductory part, the terms "fruit" or "crop" are to be understood as non-limiting with respect to the nature of the fruit or the crop and thus encompass a harvest of grapes or of stripped grapes.

The term "crop" is understood to be a mixture of fruits and unwanted debris intermingling with the fruit at the time of their collection. The debris may include foliage, small twigs, stalks, leaf stems or other extraneous matter.

The intake area of the conveyor is the part of the conveyor on which the crop is dumped. It is preferably located at the entrance of the conveyor. A hopper or another dumping mechanism may be provided above the intake area to supply the conveyor and to spread out the crop to be sorted.

The discharge area of the sorting table is preferably located at an exit of the conveyor. It is located downstream from the intake area relative to the conveying direction. The discharge area receives the debris which has not passed through the screen of the sorting table, in order to eliminate it or to process it separately.

The screen extends in the conveying plane between the intake area and the discharge area. The conveyor makes the crop pass over the screen. The length of the screen may be equal to or less than the distance separating the intake area from the discharge area.

It should be specified that a part of the conveyor may directly form the screen. This is the case when the conveyor includes sorter rollers for conveying the crop. Such sorter rollers present between them spaces which constitute the openings of the screen.

The fruit that passes through the openings of the screen is withdrawn from the crop being conveyed along the conveying plane. It is collected underneath the screen, which is to say below the conveying plane.

The conveying plane may preferably be an essentially horizontal plane. It may also be inclined relative to the horizontal as becomes clear in the description below.

The measuring device of the quantity or rate of fruit passing through the screen does not measure the total quantity or rate of fruit but is limited to only a portion of the screen. This portion is designated as "reference section".

Measurements may be taken on several reference sections succeeding each other along the screen along a conveying axis. Each reference section may, in this case, have its own measuring device. The signals from the different measuring devices or the signals from the sensors they are equipped with, can then be combined for establishing adjustment controls of the sorting table. In particular, the use of two reference sections can be advantageous for optimal adjustment of the screen of a sorting table liable to receive both clean grapes and crushed or damaged grapes. Use of two reference sections makes it possible in this case to compare the rates of grape berries passing through the screen at the beginning and at the end of the sorting table, for example.

For the sake of simplification, a single reference section is mentioned in the following description but without prejudging the number of reference sections employed for the sorting table.

The quantity of fruit and the rate of fruit passing through the screen on the reference section is used to evaluate the quantity of fruit expected to reach the discharge area at the end of the conveyor.

The reference section is situated away from the intake area of the conveyor. Preferably it may be located as close as possible to the end of the screen turned towards the discharge area. In effect, if a significant quantity of fruit passes through the screen on its reference section, and if this section is close to the end of the screen, it can be assumed that a significant portion of the fruit of the grape harvest has not been selected ahead of the reference section and risks reaching the discharge area.

Inversely, if very little or no fruit passes the reference section of the screen, one can estimate that all the fruit has already been sorted before reaching the reference section and that the remaining part of the screen unnecessarily risks passing, in an unwanted manner, debris among the sorted fruit.

The measurement taken by the measuring device may apply to an absolute quantity of fruit passing through the reference section of the screen, for example during the processing of a crop lot. However, and preferably so, the device can also be configured to measure a rate or flow which is to say a quantity of fruit passing the reference section per unit of time.

As indicated previously, the adjustment device of the sorting table is intended for modifying its selectivity.

It may act on the conveying speed, knowing that a higher conveying speed increases the selectivity of the screen, the fruit having greater tendency to remain in the conveying plane and not to pass through the screen when they are moved along at a high speed in the direction of the conveying.

The adjustment device can also act on the caliber of the screen. The caliber corresponds to the opening of the screen, that is to say its selectivity. The caliber is being determined by the dimension of the fruit passages of the screen. In the particular case of a screen comprising sorter-conveyor rollers, the caliber of the screen can be adjusted by modifying, for example, the spacing between the sorter-conveyor rollers.

It should be specified that the dimension of the fruit passages of the screen is not necessarily constant or uniform along the sorting table. The caliber is therefore understood to be an average value of screen opening.

The adjustment device can also act on the quantity of fruit present on the screen, by modifying a supply rate of the conveyor. This rate may be modified, for example by modifying the opening or the incline of a crop intake hopper on the intake area of the conveyor, by modifying the forward speed of the harvesting machine.

Finally, the adjustment device can act on an inclination of the conveyor and thus of the screen relative to the horizontal in the direction of the conveying. A slight inclination of the screen relative to the horizontal, or even a negative inclination by orienting the discharge area upward, tends to reduce its selectivity, whereas a steeper inclination has a tendency of increasing the selectivity of the screen, the forces of gravity then accelerating the speed of the fruit.

In a very crude implementation of the invention, the measurement taken by the measuring device on the reference section may be displayed and used by an operator to actuate the adjustment device.

However, and according to a particularly advantageous characteristic, the adjustment device can be servo-driven by the measuring device, for automatic adjustment. Thus, the adjustment device can be configured to adjust in real time the settings of the sorting table, depending on the quantity of fruit passing through the screen on the reference section, and thus to ensure an optimal setting, taking into account especially the variations of the quality of the crop being processed. The servo setup is described in more detail later on in the text.

The measuring device of the quantity or the flow rate of fruit passing through the reference section of the screen may be a measuring device with instant readout value, or preferably, an integrating measuring device performing a measurement over a certain length of time. Use of an integrating measuring device helps to smooth out the measurements and prevents the sorting table from being adjusted on account of abnormal instantaneous values.

According to a possible implementation of the measuring device, it may feature at least one optical barrier positioned on a fruit passage placed under the reference section of the screen, and a totalizer of openings of the optical barrier. The optical barrier is considered to be positioned on a fruit passage connected to the reference section when the fruit crossing the part of the screen corresponding to the reference section is brought to pass before the optical barrier prior to reaching the receiving are of the sorted fruit.

The optical barrier may feature one or several light beams which are interrupted by the passage of the fruit or the debris crossing the screen, coming from the reference section of the screen. The number and the diameter of the light beams are preferably adapted to the size of the fruit so as to avoid an untimely opening of the barrier in the case of a passage before the optical barrier of objects significantly smaller than the fruit, for example seeds or small items of debris.

The totalizer of openings associated to the optical barrier may be a counter of a number of openings per time unit. The totalizer then counts the number of openings of the optical barrier per time unit and issues a measuring signal representative of the number of fruits having passed through the reference section of the screen per time unit.

Use of a counter of the number of openings is adapted when the flow of fruit crossing the reference section of the screen is relatively low. When the flow becomes more significant, a situation may arise where the light beam of the optical barrier remains interrupted during a certain length of time and that during this period several fruits pass before the barrier.

In this case, the totalizer of openings may preferably be configured to establish a relationship between a duration of opening of the optical barrier and a reference duration. For example, the totalizer of openings may be configured to establish a relationship between a duration of opening of the optical barrier and a duration of closing of the optical barrier.

The opening times, of closing respectively, of the optical barrier are understood to be times during which the light bean is interrupted, respectively uninterrupted.

The totalizer of openings may also combine the two counting modes.

According to a more sophisticated implementation, the measuring device of the quantity or the rate of fruit passing the reference section of the screen may also include a camera and an image processing system associated with the camera. The camera and the image processing system can be configured to establish a number and a size of the objects crossing the reference section of the screen. In this case the image processing directly delivers an estimate of the flow of fruit in the reference section of the screen and makes it possible to distinguish, if necessary, the fruit from the debris accidentally passing through the screen.

According to another possibility of implementation of the measuring device associated to the reference section of the screen, it may include a deflector positioned in a fruit drop between the reference section of the screen and the receiving area of sorted fruit, and a totalizer of impacts on the deflector. The deflector is for example, a metal pan onto which fall the fruit that pass through the reference section of the screen, and the impact totalizer may include an accelerometer that is integral with the deflector. The accelerometer may in this case be preferably calibrated so as to post the impacts made by fruit and not by smaller objects such as fruit seeds.

The count of impacts, just like the count of openings of an optical barrier is better adapted to the count of a discrete flow of fruit than for the evaluation of a continuous flow. It is therefore preferably reserved for a reference section of short length.

For a measurement of a flow both discrete and continuous, the measuring device associated to the reference section may also include a deflector mounted as a pivot in a fruit drop between the reference section of the screen and the receiving area of sorted fruits. The pivoting deflector is associated to a return spring of the deflector in a resting position, and an angular deflection sensor of the deflector relative to the resting position. The sensor may be an optical sensor or a potentiometer pickoff, for example.

In this case, the significance of the angular deflection of the deflector depends on the number of fruits reaching the deflector per time unit and gives a measure of the flow of fruits crossing the reference section of the screen.

The measuring device may also include a fruit receptacle positioned downstream of the reference section of the screen in the receiving area of sorted fruit, and a totalizer of fruit mass in the receptacle. The mass totalizer may be a strain gauge measuring the mass or the increase of fruit mass in the receptacle. The receptacle may include an automatic discharge system of its content in the middle of the mass of sorted fruit.

As mentioned previously, adjustment of the sorting table may take place by acting on one or several parameters. One of these parameters may especially be the conveying speed. Slow conveying favors the passage of the fruit through the openings in the screen before it reaches the discharge area. Inversely, a fast conveying favors the forward movement of the fruit in the conveying plane rather than its passage through the screen which tends to increase the selectivity of the screen.

So when the adjustment device acts on the conveying speed, it may include a drive acting on a drive element. This may be any one of these:

- a drive of a power supply of an electric motor driving the conveyor;
- a supply drive for oil passing through a hydraulic motor driving the conveyor;
- a supply drive for fuel supplying a thermal engine driving the conveyor; and
- a gear drive for a transmission driving the conveyor.

The conveyor drive motors mentioned above are those supplying the mechanical energy for conveying the crop from the intake area to the discharge area. When the conveyor is a bucket or arm conveyor, passing buckets containing the crop above the screen or arms pushing the crop, the motors drive the forward movement of the buckets or arms.

The conveyor may also be a roller conveyor. It may in particular include sorter rollers forming the screen, in the manner already mentioned. In this case, the motors or the transmission mentioned above are provided for putting the rollers and/or sorter rollers in rotation. More or less rapid rotation of the rollers results in more or less rapid conveying of the crop along the sorting table.

As previously indicated, the adjustment device of the sorting table can be servo-driven by the measurement of the quantity or the flow rate of fruits passing through the reference section of the screen. It may be particularly servo-operated:

to reduce the conveying speed and/or increase the caliber of the screen, and/or reduce the inclination of the conveyor, and/or increase the supply rate of the conveyor when either the quantity of fruit or the flow rate of fruit crossing the reference section of the screen is below a low setpoint, and to increase the conveying speed and/or reduce the caliber of the screen, and/or increase the inclination of the conveyor, and/or reduce the supply rate of the conveyor when either the quantity of fruit or the flow rate of fruit crossing the reference section of the screen exceeds a high setpoint.

The high and low setpoints may be set experimentally during a calibrating phase depending especially on the location and the length of the reference section of the screen, so that a lowest possible number of fruits but not zero reaches the discharge area of the sorting table.

The reference section may preferably present a length along a conveying axis comprised between one hundredth and one quarter of a total length of the screen. In the case where several reference sections are provided, the length of the reference section is understood to be the cumulated length of the different reference sections.

Furthermore, the reference section may be located preferably at a distance from an entrance of the screen comprised between 75% and 90% of a total length of the screen. The entrance of the screen is understood to be its end directed towards the intake area of the sorting table.

Since the adjustment of the sorting table targets an operation in which a limited number of fruit reaching the discharge area while using a maximum length of the screen, precision of the measurement is all the better as the section is close to the end of the screen.

Other characteristics and advantages of the invention become clear from the description which follows, in reference to the figures of the drawings. This description is provided for illustrative purposes and is not limiting.

The different figures are represented in free scale.

DETAILED DESCRIPTION OF MODES ON IMPLEMENTATION OF THE INVENTION

In the following description identical, similar or equivalent portions of the various figures are marked with the same reference identifiers, so as to facilitate the transfer from one figure to another.

Figure 1:
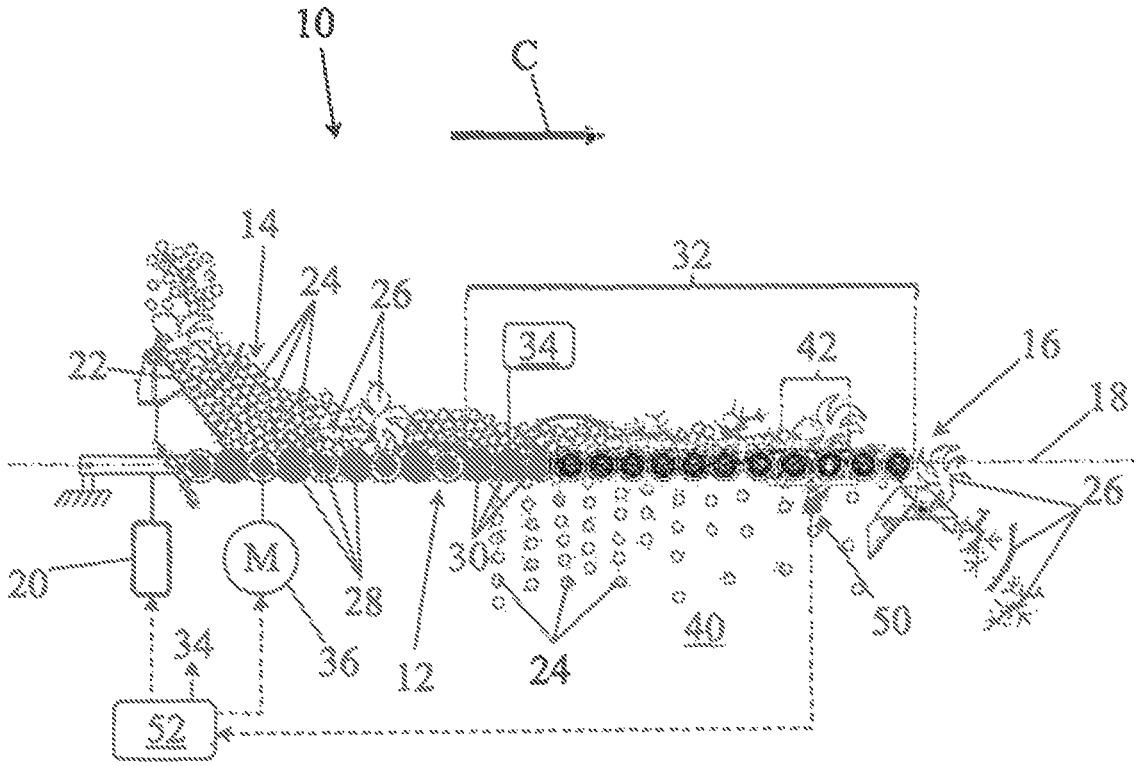
FIG. 1 is a longitudinal section of a sorting table according to the invention.

FIG. 1 shows a sorting table 10 in conformance with the invention.

It comprises a roller conveyor 12 extending from an intake area 14 to a discharge area 16 along a conveying plane 18. The conveying plane is in an essentially horizontal position. However, the sorting table and thus its conveying plane can be inclined relative to the horizontal with a jack mechanism 20.

A hopper 22 with a variable output is placed above the intake area 14 for dumping a crop into it. In the case of FIG. 1, this is a grape harvest including both grape berries 24 and debris 26 such as leaves, leaf stems or stalks to be eliminated.

The roller conveyor 12 includes a first series of roller conveyors 28, placed essentially side by side in the conveying plane 18 and perpendicularly to a conveying axis indicated by an arrow C. The arrow C also indicates a conveying direction of the intake area 14 towards the discharge area 16. After the first series of conveyor rollers 28 there is a second series of rollers which are sorter conveyor rollers 30. Sorter conveyor rollers are understood to be rollers between which appropriate spaces are made to let selectively pass fruit or debris of similar or smaller size than the fruit. The sorter conveyor rollers 30 are also positioned in the conveying plane 18, perpendicularly to the conveying axis C, following the conveyor rollers 28.

On account of the spaces provided between the successive sorter conveyor rollers these constitute a screen 32.

In the example of FIG. 1, the screen 32 extends in the prolongation of the conveying rollers 28 up to the discharge area 16 of the sorting table 10. The screen presents a caliber depending essentially on the spaces, or passage openings made between the sorter conveyor rollers 30. The caliber of the screen can be adjusted, especially by a sliding device 34 allowing modification of the distance between the sorter conveyor rollers. The sliding device 34 is symbolically represented on FIG. 1.

The conveyor rollers 28, just like the sorter conveyor rollers 30 are driven in rotation by an electric motor 36 represented symbolically. All the rollers are put into rotation in the same direction, as it happens clockwise in this case of FIG. 1 to move the grape harvest from the intake area 14 towards the discharge area 16, parallel to the conveying axis C.

As the conveying progresses, when the grape harvest passes over the screen 32, the grape berries 24 in contact with the screen or near the screen pass through the screen to reach an area 40 for receiving sorted fruit under the screen 32 and under the conveying plane 18. A collector of sorted fruit, not shown, may be placed in this area. In this manner, the number of grape berries 24 remaining on the sorting table diminishes as the conveying along the conveying axis C continues.

The sorting table of FIG. 1 is represented in an optimal configuration in which no more fruit, or almost no more fruit remains on the sorting table at the end of the screen 32 and as the discharge area 16 approaches. So only the debris 26 remains on the sorting table and is dropped in the discharge area to be discarded.

The screen 32 of the sorting table of FIG. 1 includes a reference section 42 here constituted by two reference sorter conveyor rollers. The reference section 42 is positioned in the vicinity of the end of the screen directed towards the discharge area 16. It is associated to a measuring device 50 intended for measuring a quantity or flow of fruits, here grape berries 24, passing through the screen on the reference section. In the particular example of FIG. 1, the measuring device 50 determines the quantity or flow of fruit crossing the screen between the two sorter conveyor rollers of the reference section 42.

The measuring device 50 delivers a measurement signal destined for an adjustment device 52 acting on various parameters of the sorting table. This is for example an optical sensor measuring the occultations by the grape berries, or possibly the debris items crossing the sorting table at the reference section 42. The adjustment device 52 acts in particular on the power supply to the electric motor 36 to vary the rotational speed of the rollers 28, 30 and thus the conveying speed. It also acts on the jack mechanism 20 which serves to incline the sorting table. Lastly it acts on the sliding device 34 intended for adjusting the opening and thereby the caliber of the screen 32 of the sorting table. In the case where the sorting table is mounted on a harvesting machine, the adjustment device can also act on the speed of the harvesting machine to adjust the rate of harvested grapes arriving in the intake area of the sorting table. In general, the adjustment device can send a signal to the grape harvest supply system of the sorting table to vary the rate of harvested grapes arriving in the intake area of the sorting table.

Figure 2:
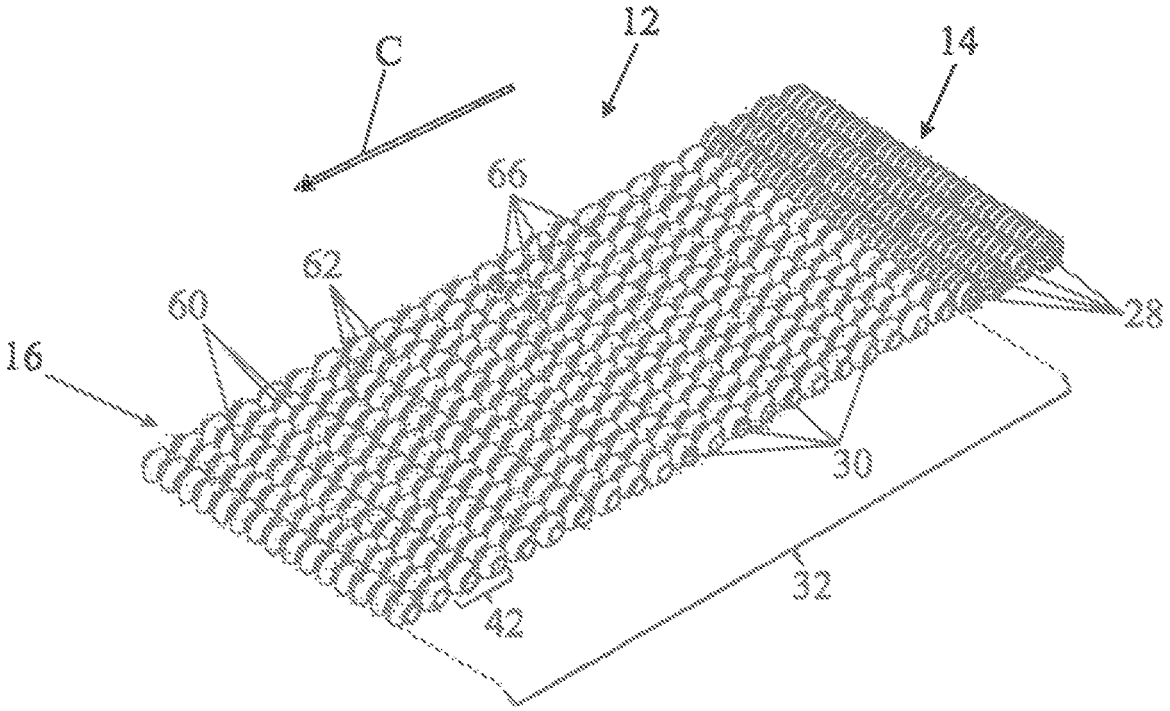
FIG. 2 is a perspective view of a conveyor and a screen of a sorting table according to the invention.

FIG. 2 is a perspective view of a conveyor 12 of a sorting table in conformance with the invention.

Just like the conveyor of FIG. 1, the conveyor 12 of FIG. 2 extends from an intake area 14 to a discharge area 16. The conveyor is formed by a plurality of rollers 28, 30.

In the intake area there are four conveyor rollers 28. These rollers are almost contiguous. They serve to spread the crop and trigger its transport along the conveying axis C, perpendicular to the rollers when they are put into rotation. They also serve to remove from between the rollers the juices and very small items of debris such as grape seeds.

The conveyor rollers 28 are followed by a plurality of sorter conveyor rollers 30 also capable of being put into rotation, in concert with the conveyor rollers 28 for conveying the crop. Each conveyor roller presents a regular alternation of sorting sections 60 and of annular collars 62. The annular collars present a diameter larger than the sorting sections and slightly overlap from one sorter conveyor roller to the next.

The sorting sections 60, successive conveyor rollers which are opposite, do not touch each other. They present between themselves spaces or openings 66. The spaces 66 are thus delimited by the sorting sections perpendicularly to the conveying axis C and are delimited by the annular collars parallel to the conveying axis C. Thanks to the spaces 66 the sorter conveyor rollers 30 constitute a screen 32.

A portion of the screen, in the vicinity of the discharge area 16 constitutes the reference section 42 of the screen.

Figure 3:
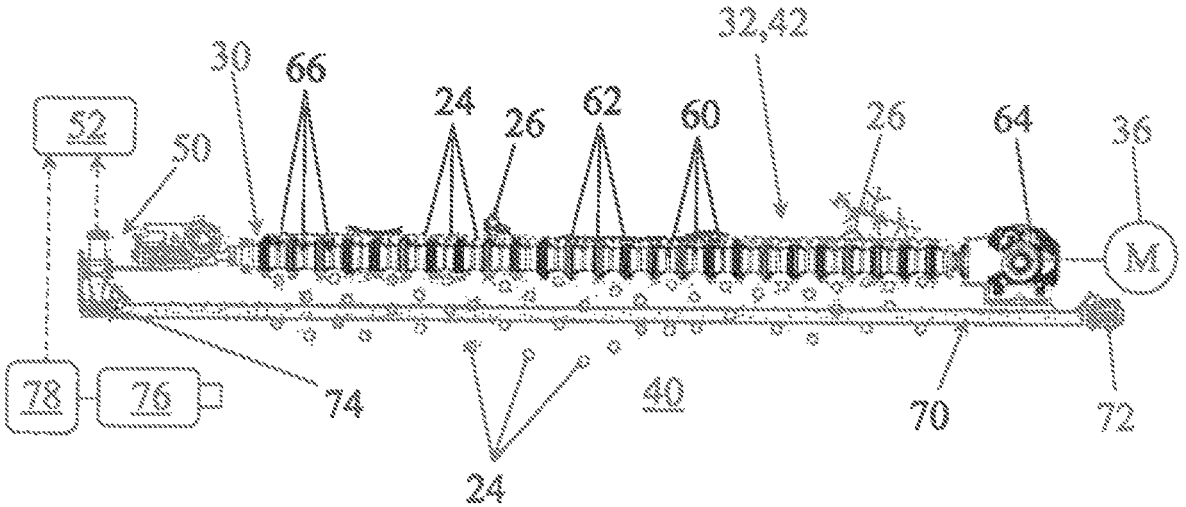
FIG. 3 is a plan view of a sorter-conveyor roller and a measuring device of the sorting table of FIG. 1.

FIG. 3 is a plan view, parallel to its axis and in a plane perpendicular to the conveying axis C of FIGS. 1 and 2, of a sorter conveyor roller 30 taken in the reference section of the screen.

One can observe in one of the ends of the sorter conveyor roller a transmission mechanism 64 linked to the electric motor 36, represented symbolically. The transmission mechanism 64 serves to communicate to the sorter conveyor roller 30 a rotational movement for the conveying of the grape harvest.

The conveyed grape harvest includes grape berries 24 and debris 26 present on the roller, in contact with the sorting sections 60 and the annular collars 62.

FIG. 3 also shows the measuring device 50 which here includes an optical barrier 70 formed by an emitter 72 and a receiver 74 of a light beam. The receiver 74 forms a totalizer of the opening. The light beam of the optical barrier extends parallel to the sorter conveyor roller 30 under the spaces 66 which separate the sorter sections 60 from those of the following sorter conveyor roller not shown.

The grape berries which pass through the reference section 42 of the screen 32 thus trigger openings of the optical barrier 70 as they drop towards the area 40 for receiving sorted fruit.

The measuring device 50, and in particular the totalizer of openings, delivers a signal counting the number of openings or the relative duration of the openings of the optical barrier 70. This signal is directed towards the adjustment device 52 already mentioned in connection with FIG. 1.

As a complement, or even as a replacement, of the optical barrier, the measuring device may feature a camera 76 associated to an image processing system 78, for example a software control system, to deliver a representative signal of a flow of fruit across the reference section 42 of the screen 32.

Figure 4:
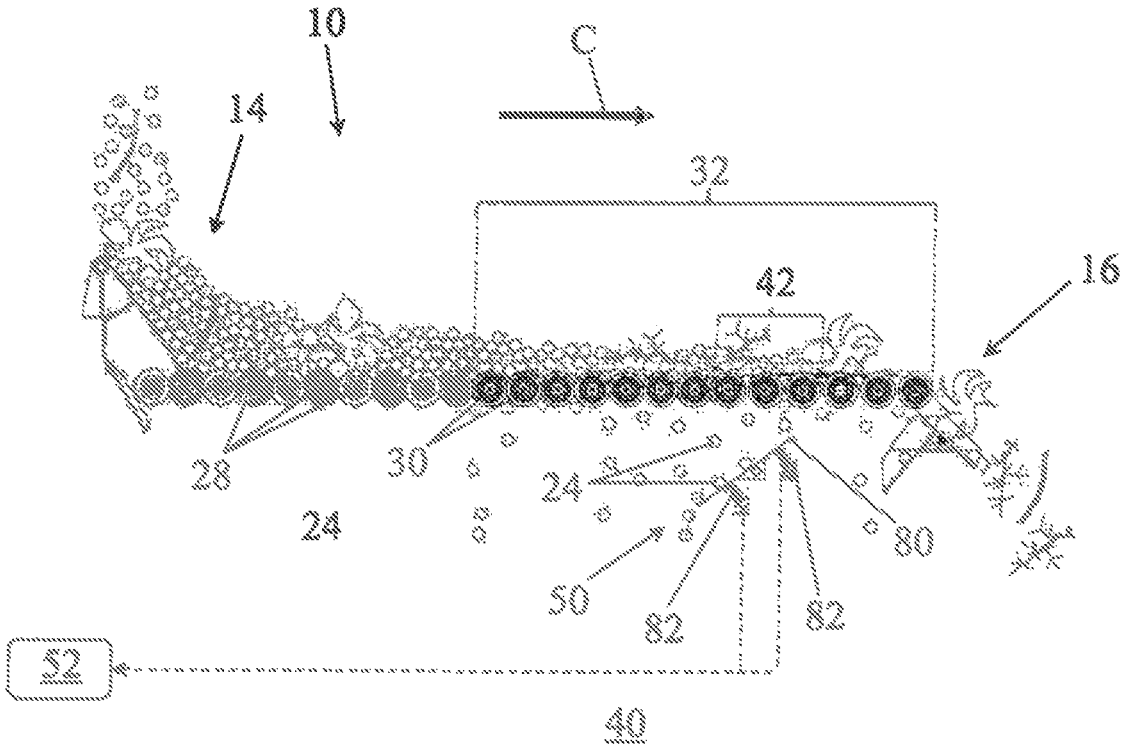
FIG. 4 is a longitudinal section of another sorting table in conformance with the invention with another type of measuring device.

FIG. 4 is a longitudinal section comparable to FIG. 1 and shows another possibility of implementation of the measuring device 50.

The screen 32 of FIG. 4 presents a reference section 42 formed by three sorter conveyor rollers 30.

A measuring device 50 is associated to the reference section 42. The measuring device includes a deflector 80, for example a metallic plate mounted under the reference section 42 of the screen 32 so as to be struck by the grape berries 24 which cross the reference section 42 of the screen 32, as they drop towards the area 40 for receiving sorted fruit. The deflector 80 is associated to impact totalizers 82. The impact totalizers may be optical or mechanical devices, for example accelerometers, supplying a measurement signal for the adjustment device 52. The impact totalizers can be calibrated to be sensitive to the dropping of sorted grape berries and not just to simple seeds, for example.

Figure 5:
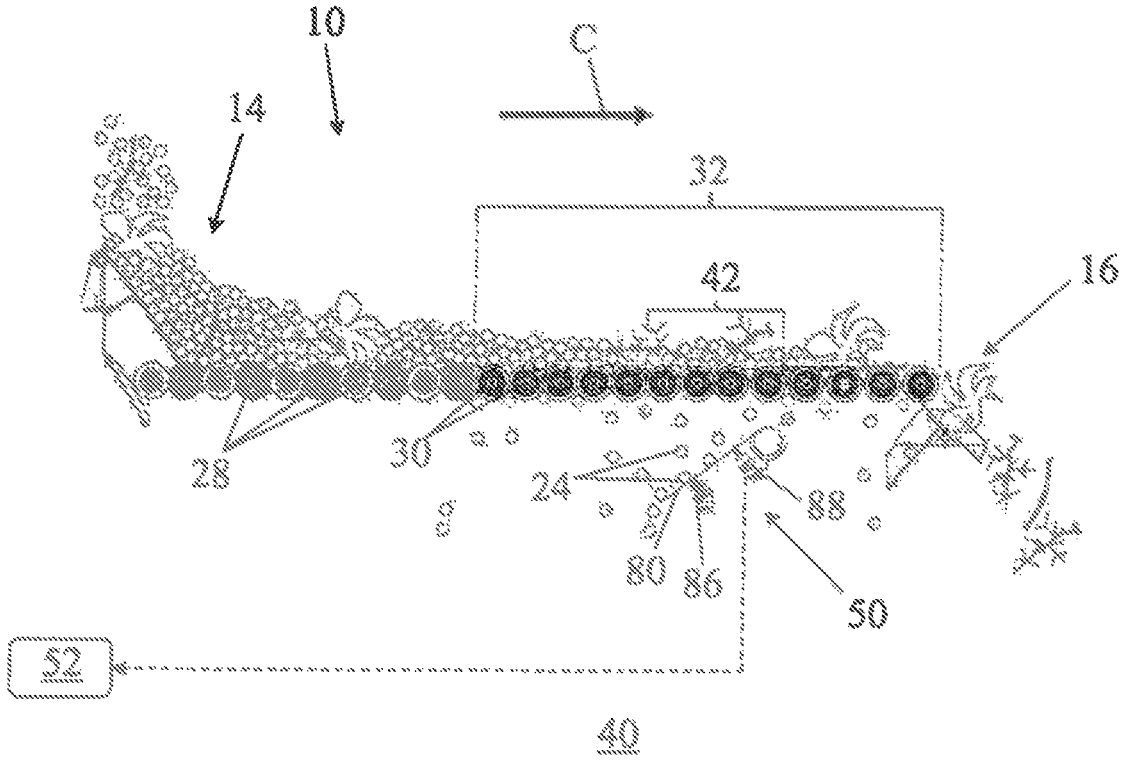
FIG. 5 is a longitudinal section of another sorting table in conformance with the invention with another type of measuring device.

FIG. 5 shows a variant of the device of FIG. 4 in which the reference section extends over four consecutive sorter conveyor rollers. The measuring device 50 also includes a deflector 80. Each deflector 80 is mounted in pivoting fashion in the fruit chute under the reference section 42 of the screen 32.

The deflector 80 is charged by a return spring 86 which returns it to a resting position. The falling grape berries 24 passing through the reference section 42 of the screen 32 and reaching the deflector 80 tend to make the deflector pivot out of its resting position. The pivoting angle varies with the flow of the grape berries crossing the reference sections. A sensor of angular deflection 88, for example a sensor with a potentiometer or an angular optical sensor measures the angle of deflection of the deflector and delivers a representative signal of the flow of berries that is intended for the adjustment device 52. In fact, in this mode of implementation the angular deflection of the deflector 80, relative to its resting position is proportional to the flow of berries, or at least representative of a flow of berries reaching the deflector, and hence of the flow of berries crossing the reference section 42 of the screen.

Figure 6:
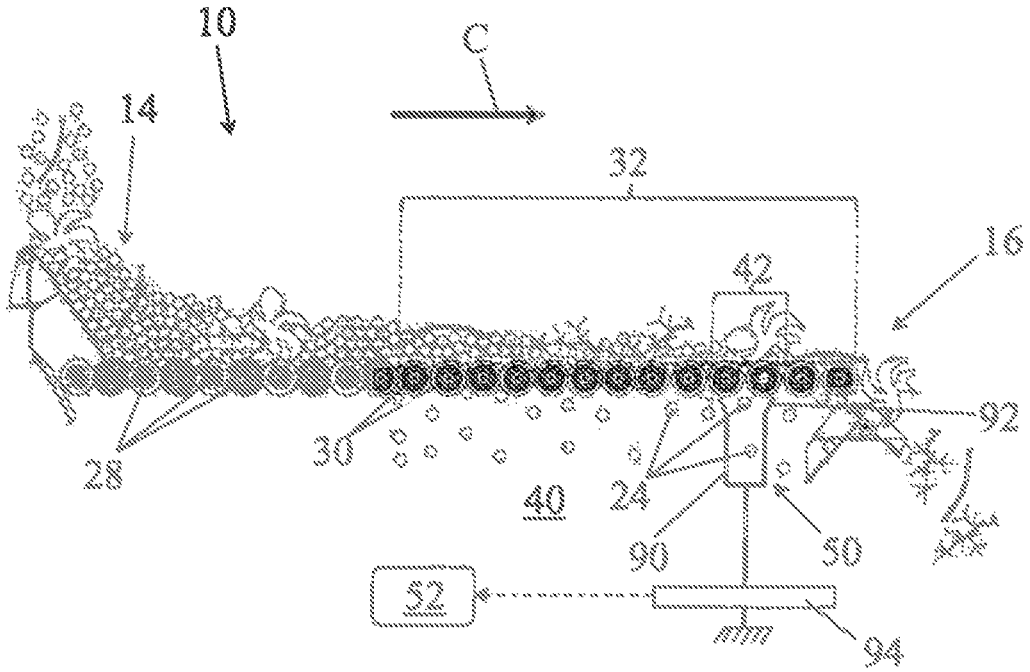
FIG. 6 is a longitudinal section of another sorting table in conformance with the invention with yet another type of measuring device.

FIG. 6 is a longitudinal section of a sorting table comparable to that of FIG. 1 and illustrates yet another possibility of implementation of the measuring device 50 of the flow of berries through a reference section 42 of the screen 32.

The measuring device of the flow of berries of FIG. 6 includes a receptacle 90 positioned in the area 40 for receiving sorted fruit. The receptacle 90 presents an opening 92 adjusted to the dimension of the reference section 42 of the screen 32 and positioned below the reference section. In this way, the berries 24 passing through the screen 32 through the reference section 42 are collected in the receptacle 90.

The receptacle 90 is associated to one or several strain sensors 94, and thus constitutes scales or a mass totalizer making it possible to measure a mass of collected berries.

The strain sensor can deliver a signal of mass, mass growth or mass growth per time unit, representative of the flow of berries across the reference section 42 of the screen. This signal is provided to the adjustment device 52 so as to control the parameters of the sorting table.

In effect, as shown previously, it is possible to adjust the conveying speed, the intake rate, the incline of the sorting table and the caliber in order to obtain a target flow of berries across the reference section. This target flow is such that the number of berries arriving at the discharge area 16 is virtually zero.

The invention claimed is:

1. A fruit sorting table comprising:

a conveyor adapted to convey a fruit crop along a conveying plane, said conveyor having intake area adjacent one end and a discharge area adjacent another end;

a screen extending in the conveyor plane between the intake area and the discharge area, said screen having openings adapted to allow fruit to pass from conveying plane toward a receiving area under the conveying plane that receives sorted fruit;

an adjustment device for setting a selectivity of the sorting table; and at least one measuring device adapted to measure either a quantity of fruit or a flow rate of fruit passing through the screen over at least one reference section of the screen, the reference section located between the intake area and the discharge area and at a distance away from the intake area, wherein said at least one measuring device has at least one optical barrier and a totalizer of openings of the at least one optical barrier.

2. The fruit sorting table of claim 1, wherein said adjustment device acts upon at least one parameter selected from the group consisting of a conveying speed of said conveyor, a caliber of said screen, a supply rate of said conveyor, and an inclination of said conveyor relative to horizontal.

3. The fruit sorting table of claim 1, wherein said adjustment device is connected to said at least one measuring device so as to be dependent on measurements taken by said at least one measuring device.

4. The fruit sorting table of claim 1, wherein the totalizer of openings is a totalizer of a number of openings per time unit.

5. The fruit sorting table of claim 1, wherein the totalizer of openings is configured to establish a relationship between a length of time of opening the at least one optical barrier and a reference duration.

6. The fruit sorting table of claim 1, wherein the totalizer of openings is configured to establish a relationship between a length of time of opening the at least one optical barrier and a length of time of closing the at least one optical barrier.

7. The fruit sorting table of claim 1, wherein said at least one measuring device is a camera and an image processing system cooperative with the camera.

8. A fruit sorting table comprising:

a conveyor adapted to convey a fruit crop along a conveying plane, said conveyor having intake area adjacent one end and a discharge area adjacent another end;

a screen extending in the conveyor plane between the intake area and the discharge area, said screen having openings adapted to allow fruit to pass from conveying plane toward a receiving area under the conveying plane that receives sorted fruit;

an adjustment device for setting a selectivity of the sorting table; and, at least one measuring device adapted to measure either a quantity of fruit or a flow rate of fruit passing through the screen over at least one reference section of the screen, the reference section located between the intake area and the discharge area and at a distance away from the intake area, wherein said at least one measuring device comprises:

a deflector positioned in a fruit chute between the at least one reference section of said screen and the receiving area; and a totalizer cooperative with said deflector so as to count impacts on said deflector.

9. A fruit sorting table comprising:

a conveyor adapted to convey a fruit crop along a conveying plane, said conveyor having intake area adjacent one end and a discharge area adjacent another end;

a screen extending in the conveyor plane between the intake area and the discharge area, said screen having openings adapted to allow fruit to pass from conveying plane toward a receiving area under the conveying plane that receives sorted fruit;

an adjustment device for setting a selectivity of the sorting table; and at least one measuring device adapted to measure either a quantity of fruit or a flow rate of fruit passing through the screen over at least one reference section of the screen, the reference section located between the intake area and the discharge area and at a distance away from the intake area, wherein said at least one measuring device comprising:

a deflector pivotally mounted in a fruit chute between the at least one reference section of said screen and the receiving area;

a return spring connected to said deflector so as to return said deflector to a resting position; and a sensor cooperative with said deflector so as to measure an angular deflection of said deflector relative to the resting position.

10. The fruit sorting table of claim 1, wherein said at least one measuring device further comprises:

a fruit, receptacle; and a totalizer cooperative with said fruit receptacle so as to measure a fruit mass in said fruit receptacle.

11. The fruit sorting table of claim 1, wherein said adjustment device acts on a conveying speed of said conveyor, said adjustment device selected from the group consisting of a drive of a power supply of an electric motor driving said conveyor, a drive for a supply rate of oil passing through a hydraulic motor driving said conveyor, a drive fora supply rate of fuel supplying, a thermal engine driving said conveyor, and a gear drive for a transmission driving of said conveyor.

12. The fruit sorting table of claim 1, wherein said conveyor is a roller conveyor.

13. The fruit sorting table of claim 12, wherein the roller conveyor has sorter conveyor rollers that define said screen.

14. The fruit sorting table of claim 13, wherein said adjustment device has a slide adapted to adjust a distance between the sorter conveyor rollers.

15. The fruit sorting table of claim 3, wherein said adjustment device is servo-driven, said adjustment device reducing a conveying speed of said conveyor or increasing a caliber of said screen or reducing an inclination of said conveyor or increasing a supply rate of said conveyor when a quantity of the fruit or a flow rate of fruit crossing the at least one reference section of said screen is below a low setpoint.

16. The fruit sorting table of claim 3, wherein said adjustment device is servo-driven, said adjustment device increasing a conveying speed of said conveyor or reducing a caliper of said screen or increasing an inclination of said conveyor or reducing a supply rate of said conveyor when either a quantity of fruit or flow rate of fruit crossing the at least one reference section of said screen is above a high setpoint.

17. The fruit sorting table of claim 1, wherein the at least one reference section of said screen has a length along an axis of said conveyor, the length being between one hundredth and one quarter of a total length of said screen.

18. The fruit sorting table of claim 1, wherein the at least one reference section is positioned at a distance from an entrance of said screen, the distance being between 75% and 90% of a total length of said screen.

* * * * *